United States Patent [19]

Noble et al.

[11] 4,241,915

[45] Dec. 30, 1980

[54] ADJUSTABLE EXERCISE APPARATUS

[76] Inventors: David Noble; Donald Noble, both of R.F.D. 6, Box 358, Richmond, Va. 23231

[21] Appl. No.: 3,830

[22] Filed: Jan. 16, 1979

[51] Int. Cl.[3] ..... A63B 23/02

[52] U.S. Cl. ..... 272/144

[58] Field of Search ..... 272/109, 111, 117, 134, 272/144, 145; 128/25 R

[56] References Cited

U.S. PATENT DOCUMENTS

| | | | |
|---|---|---|---|
| 42,516 | 4/1864 | Taylor | 128/25 R |
| 309,678 | 12/1884 | Aubin | 272/144 X |
| 1,721,709 | 7/1929 | Odell | 272/144 |
| 3,173,415 | 3/1965 | Rubin | 272/109 X |
| 3,545,748 | 12/1970 | Delinger | 272/134 X |
| 3,572,701 | 3/1971 | Agamian | 272/144 |
| 3,589,720 | 6/1971 | Agamian | 272/134 X |
| 3,817,243 | 6/1974 | Perrine | 272/145 X |
| 3,947,023 | 3/1976 | Martin | 272/109 X |
| 3,971,561 | 7/1976 | Wenzel | 272/109 X |

FOREIGN PATENT DOCUMENTS

| | | | |
|---|---|---|---|
| 911,938 | 4/1946 | France | 272/144 |

*Primary Examiner*—Richard J. Apley

*Attorney, Agent, or Firm*—Norman B. Rainer

[57] ABSTRACT

A compactly foldable exercise apparatus is provided for performing the exercises of sit-ups and push-ups. An adjustably inclinable board provided with foot engaging means adjacent the forward end thereof is positioned generally above a base associated with track means carrying a pair of opposed handgrips. Locking means slideably engage each handgrip with said track means in a manner to facilitate adjustable spacing between said handgrips and to prevent twisting or tilting movement. The apparatus is adapted for performing sit-ups of varying difficulty of execution based upon the angle of inclination of said board, and is adapted for performing push-ups when said board is lowered to a position substantially parallel to said base.

8 Claims, 7 Drawing Figures

ADJUSTABLE EXERCISE APPARATUS

BACKGROUND OF THE INVENTION

1. Field of the Invention

This invention relates to improvements in exercise devices and more particularly to an adjustable, compactly foldable apparatus useful in performing at least two different types of exercises.

2. Discussion of the Prior Art

The exercise known as a push-up is widely practiced by many people to aid in the improvement of muscular development of the arms, shoulders, chest and back. In performing the push-up, the exerciser's body is in an outstretched or prone position. The hands engage the underlying floor or other support means at sites spaced apart at shoulder width and symmetrically disposed about the body axis. Pressing downward upon such support means, the exerciser repeatedly raises and lowers his body while his feet remain in unaltered positions and the body is maintained reasonably straight and rigid.

In those instances where the hands are placed directly on the floor, proper positioning of the hands for best comfort is easily accomplished because of the continuous nature of the floor. However, the open hand engaging the flat floor causes strain at the palms and wrists because of the unnatural angular juxtaposition of the hand relative to the wrist, and this position fails to properly exercise certain muscles adjacent the elbow.

Because of the aforementioned shortcoming of using a flat surface as the hand support for push-ups, the use of handgrips has been resorted to in certain instances. Said handgrips are of generally cylindrical shape and are supported high enough above a floor or other support to enable the fingers and knuckles to pass underneath said handgrip. The use of handgrips instead of a flat surface provides greater comfort and facilitates greater involvement of muscles of the forearm and elbow regions.

Several problems are however engendered by the use of handgrips. In particular, there is the hazardous possibility that the handgrip will tip over while the exerciser's body is poised thereabove. This could result in a fractured wrist or other injuries. Efforts to design handgrips resistant to tipping or tilting movement have generally resulted in structures lacking the necessary mobility for facile adjustment of the spacing therebetween. For example, the use of immobile handgrips in apparatus for performing push-ups is disclosed in U.S. Pat. Nos. 3,496,577 and 3,572,701.

In the exercise known as sit-ups, the exerciser, in a supine position, raises his head and upper torso, directing them toward his feet. This exercise is particularly useful in developing the abdominal muscles. Various degrees of difficulty may be imposed in performing sit-ups, particularly by utilizing a board adjustable to different angles of inclination and having means at the upper end thereof for engaging the feet. The principle of such inclined boards for performing sit-ups is well known. However, means for elevating one end of the board and locking the board's position may require structures separate from the board itself. In those instances where means for elevation and locking are part of an integral exercise apparatus, said apparatus is generally of large size, requiring considerable space for utilization and storage.

It is an object of the present invention to provide an exercise apparatus useful for performing push-ups and sit-ups.

It is a further object of this invention to provide an apparatus for performing push-ups utilizing handgrips which are positionable and resistant to tilting.

It is a still further object of the present invention to provide an exercise apparatus for performing sit-ups having an inclinable board and means for inclining said board and locking it into a desired inclined position.

It is a still further object of this invention to provide an exercise apparatus as aforementioned capable of being folded to a relatively compact size for storage and shipping purposes.

These and other object and advantages of the invention will be apparent from the following description.

SUMMARY OF THE INVENTION

The above and other beneficial objects and advantages are accomplished in accordance with the present invention by the provision of an improved apparatus comprising an elongated base, opposed tracks mounted adjacent the forward end of said base at right angles thereto, raised handgrips engaged by said tracks for adjustable spacing therebetween, a flat elongated padded member having foot engaging means adjacent the forward end thereof, and a post which connects said padded member with the forward end of said base by pivot means disposed at each end of said post. The rearward end of said padded member is adapted to engage with positioning means associated with the rearward end of said base, thereby causing said padded member to assume a predetermined angle of inclination in spanning the distance between said post and said positioning means.

BRIEF DESCRIPTION OF THE DRAWINGS

In the accompanying drawing forming a part of this specification and in which similar numerals of reference indicate corresponding parts in all the figures of the drawing.

DESCRIPTION OF THE PREFERRED EMBODIMENTS

Figure 1:
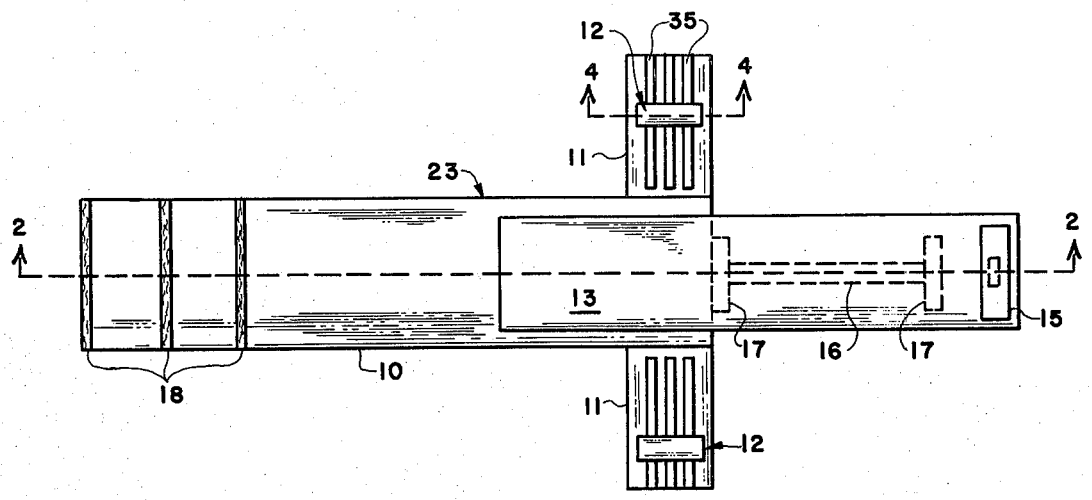
FIG. 1 is a plan view of an embodiment of apparatus of the present invention in a functional mode adapted for push-ups.

Referring to the exercise apparatus shown in FIG. 1, an elongated base 10 joins at its forward end with track means comprised of opposed track sections 11 to form a generally coplanar T-shaped structural foundation 23. A handgrip assembly 12 slideably engages each track section in a manner to be hereinafter described. An elongated board 13 having a resiliently padded upper surface 22 is positioned generally above base 10 and connected thereto by means of post 16 having hinge-like pivoting terminals 17 which attach to the underside of board 13 and the forward end of foundation 23. Foot engaging means 15 comprised of padded cylindrical member 19 and vertical spacer 20 is positioned on the upper surface of board 13 adjacent the forward end thereof. Positioning means in the form of parallel cleats 18 are located adjacent the rearward end of base 10 in perpendicular disposition to the longitudinal axis thereof. The vertical plane indicated by section line 2—2 represents a plane of symmetry of the apparatus.

Figure 2:
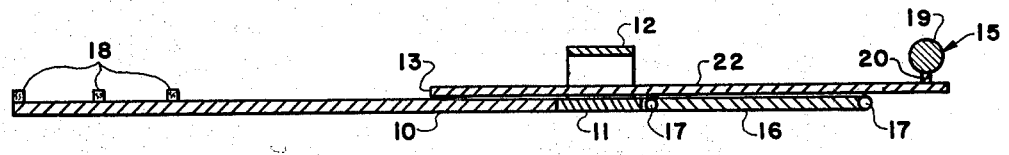
FIG. 2 is a sectional side view taken along the lines 2—2 of FIG. 1.

When the apparatus is used for push-ups, as shown in FIGS. 1 and 2, board 13 is placed in its forward-most position, whereby it rests substantially flat against base 10, and the spacing between handgrip assemblies 12 is adjusted to the user's preference. When the apparatus is used for sit-ups, as shown in FIG. 3, board 13 is raised at its forward end by post 16, assuming an angle determined by engagement of the rearward end of said board with a suitable cleat 18.

Figure 3:
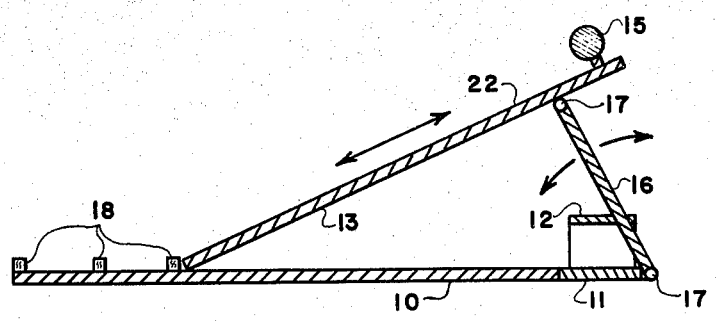
FIG. 3 is a sectional side view of the apparatus of FIG. 1 in a functional mode adapted to accomodate sit-ups.
Figure 4:
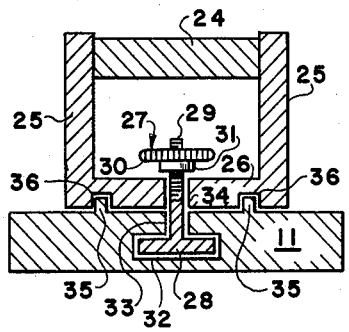
FIG. 4 is an enlarged transverse sectional view of a handgrip assembly taken along the lines 4—4 of FIG. 1.
Figure 6:
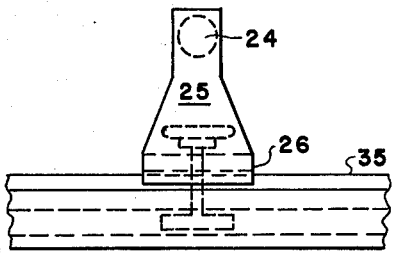
FIG. 6 is a side view of a handgrip assembly taken along the lines 6—6 of FIG. 5.
Figure 5:
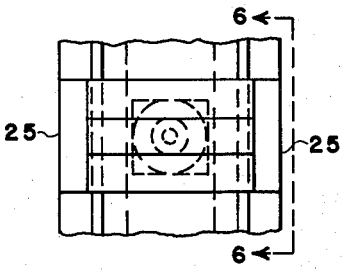
FIG. 5 is a plan view of the handgrip assembly of FIG. 4.
Figure 7:
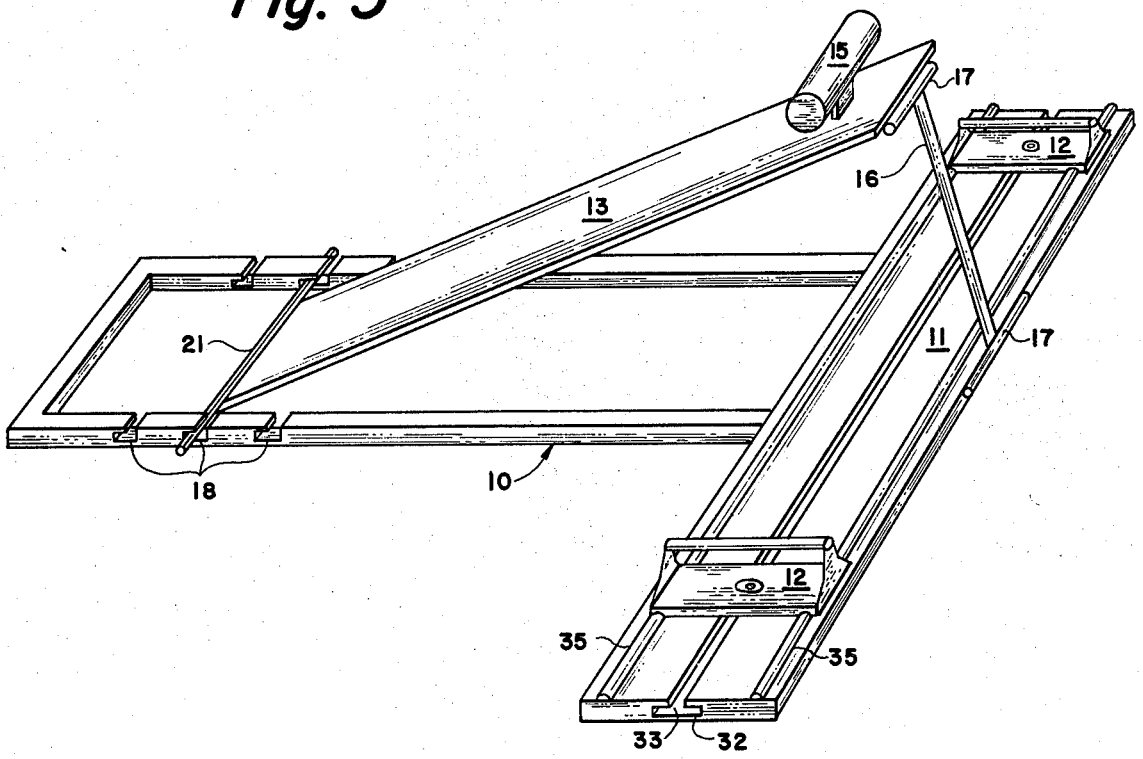
FIG. 7 is a perspective view of another embodiment of apparatus of the present invention adjusted to a functional mode to accommodate the sit-up exercise.

The base 10 may be of board-like design as exemplified in the embodiment of FIGS. 1, 2 and 3, or may have the form of a U-shaped metal frame as shown in FIG. 7, or may have still other functionally equivalent configurations. The function of positioning means 18 to anchor the rearward end of board 13 at any of several sites adjacent the rearward end of base 10 may be achieved by the upraised cleats 18 exemplified in the embodiment of FIGS. 1, 2 and 3, or by the recesses 18 in base 10 of FIG. 7 which engage anchor rod 21 attached to the rearward end of board 13, or by still other functionally equivalent constructions.

Each handgrip assembly 12 is comprised of a rounded handgrip bar 24 maintained in horizontal disposition by parallel vertical supports 25 extending upwardly from positioning platform 26. Locking means 27 associated with platform 26 is comprised of rectangular plate 28, threaded stem 29 extending upwardly from attachment at the center of said plate, and knurled knob 30 having spacing collar 31 attached to the underside thereof. Rectangular plate 28 is dimensioned to closely fit within horizontal channel 32 in track means 11. Threaded stem 29 passes through vertical channel 33 communicating with channel 32, and through a close-fitting cylindrical passageway 34 centered in platform 26. By tightening knob 30, locking means 27 causes the bottom of platform 26 to be drawn into tight compressive engagement with the upper face of track means 11, thereby preventing tilting movement of the handgrip assembly. Paired parallel up-raised ridges 35 in the upper face of track means 11 engage with grooves 36 in the underside of platform 26. The function of the engagement of ridges 35 with grooves 36 is to maintain parallel alignment of the handgrips and prevent twisting movements about a vertical axis during use.

Track means 11 may have the form of a single integral member which attaches at right angles to the forward end of base 10, as shown in FIG. 7, or may have the form of paired members which attach in opposed relationship to the sides of base 10, as shown in FIG. 1. The means by which said track means 11 is attached to base 10 may comprise conventional bolted brackets or equivalent means which afford sturdy fastening yet which enable facile assembly of the component parts of the apparatus from a compact shipping package.

Pivoting terminals 17 are preferably elongated in a direction perpendicular to the plane of symmetry of the apparatus. Such configuration aids in preventing board 13 from tilting rotatively about its longitudinal axis during use. Said terminals may involve a hinge-like principle for permitting pivoting movement or may utilize other equivalent principles of construction. It is preferred that the specific design of one or both of said terminals be such as to permit assembly by the user from a compact shipping package. Post 16 is preferably a single integral member such as a pipe threaded or otherwise adapted at each end for engagement with terminals 17. Alternative constructions of said post may however involve multi-component designs which lock in place from a folded state.

The various structural components of the apparatus may be fabricated from wood, metal, plastics or other rigid durable materials. The padding utilized on the upper surface of board 13 and on cylindrical member 19 of foot engaging means 15 may be comprised of resilient cellular polymeric material, fibrous batting, or the like, and covered with a flexible sheet material such as fabric-reinforced plasticized polyvinylchloride, or equivalent sheet materials.

In certain embodiments of the apparatus of this invention, a foot stand may be positioned above base 10 in engagement therewith adjacent its rearward end. The function of said stand is to permit the user to elevate his feet relative to handgrip assemblies 12 so that greater force will be required to perform push-ups.

While particular examples of the present invention have been shown and described, it is apparent that changes and modifications may be made therein without departing from the invention in its broadest aspects. The aim of the appended claims, therefore is to cover all such changes and modifications as may fall within the true spirit and scope of the invention.

Having thus described our invention, what is claimed is:

1. An adjustable, compactly foldable exercise apparatus comprising an elongated base, track means communicating with said base at right angles thereto forming a substantially coplanar foundation, a pair of handgrips engaged by said track means in adjustable spaced relationship, a flat elongated board positioned generally above said base and having foot engaging means adjacent the forward end thereof, elevating means pivotably connecting said foundation with said board in a manner to adjustably incline said board with respect to said base, and positioning means adjacent the rearward end of said base adapted to anchor the rearward end of said board so as to cause said board to assume a desired angle of inclination with respect to said base, whereby said apparatus is adapted for performing sit-ups and is adapted for performing push-ups when said board is lowered to a position substantially parallel to said base, said apparatus possessing a plane of symmetry which includes the longitudinal axes of said base and board.

2. Apparatus of claim 1 where said foot engaging means and the upper surface of said elongated board are provided with padding means.

3. Apparatus of claim 1 wherein said track means attaches to said base at a location adjacent the forward end of said base.

4. Apparatus of claim 1 wherein said foundation has a substantially T-shaped configuration.

5. Apparatus of claim 1 wherein said elevating means is connected to said foundation adjacent the forward end thereof.

6. Apparatus of claim 1 wherein said elevating means is connected to said foundation and board by elongated pivoting terminals disposed in a direction perpendicular to said plane of symmetry and adapted to prevent said board from tilting rotatively about its longitudinal axis.

7. Apparatus of claim 1 wherein said handgrips are horizontally disposed members supported by an assembly having locking means for achieving secure attachment to said track means.

8. Apparatus of claim 7 wherein said assembly, in conjunction with said track means, is adapted to prevent rotation of said handgrips in a horizontal plane.

* * * * *